United States Patent [19]

Matsui et al.

[11] Patent Number: 4,525,404

[45] Date of Patent: Jun. 25, 1985

[54] PILE ARTICLES WITH ATTENUATED UPPER PORTION AND A METHOD FOR PRODUCING THE SAME

[75] Inventors: Masao Matsui, Takatsuki; Kazuo Okamoto; Tutomu Naruse, both of Osaka, all of Japan

[73] Assignees: Kanebo, Ltd., Tokyo; Kanebo Synthetic Fibers, Ltd., Osaka, both of Japan

[21] Appl. No.: 636,200

[22] Filed: Jul. 31, 1984

[30] Foreign Application Priority Data

Aug. 12, 1983 [JP] Japan ..... 58-148612
Nov. 12, 1983 [JP] Japan ..... 58-212880

[51] Int. Cl.[3] ..... A01N 1/00

[52] U.S. Cl. ..... 428/92; 8/532; 26/1; 428/16; 428/97; 428/373; 428/379

[58] Field of Search ..... 428/16, 92, 97, 373, 428/397; 8/532; 26/1

[56] References Cited

U.S. PATENT DOCUMENTS

| | | | |
|---|---|---|---|
| 2,737,702 | 3/1956 | Schmidt et al. | 428/92 |
| 4,340,631 | 7/1982 | Endo | 428/92 |
| 4,461,791 | 7/1984 | Matsui et al. | 428/92 |

*Primary Examiner*—Marion E. McCamish
*Attorney, Agent, or Firm*—Flynn, Thiel, Boutell & Tanis

[57] ABSTRACT

An artificial fur-like pile article is a cloth-like fibrous structure provided with piles having a length of more than 10 mm, each pile composed of a non-attenuated portion where the fineness does not substantially vary in the length direction, an attenuated portion where the fineness is gradually reduced toward the top end and a fine top end, (a) the non-attenuated portion being composed of a core-sheath composite fiber having a flatness ratio of 1.5–5 and a fineness of 8-50 d, and having 1–4 wing-shaped projections in cross-section, (b) the top end being formed of an exposed core of the composite fiber and having a substantially uniform fineness of an average diameter of 5–25 μm and a length of 0.3–5 mm and (c) the attenuated portion having a length of 1–15 mm.

Said pile article is produced by rotating the cloth-like fibrous structure provided with cut piles having a length of more than 10 mm, which are composed of sheath-core composite fibers, each consisting of a sheath of a fiber-forming polyester and a core of thermoplastic polymer of which the decomposition rate owing to an aqueous solution of NaOH is lower than that of the polyester, and having 1–4 wing-shaped projections, a flatness ratio of 1.5–5, an average diameter of the core portion of 5–25 μm and a fineness of 8-50 d fixed to a rotating body, contacting the piles with an aqueous solution of an alkali while varying the contacted length by applying a centrifugal force in a direction to which the piles are raised, to gradually attenuate the piles toward the top end, and completely decomposing and removing the sheath polymer at the top end portion.

8 Claims, 13 Drawing Figures

PILE ARTICLES WITH ATTENUATED UPPER PORTION AND A METHOD FOR PRODUCING THE SAME

BACKGROUND OF THE INVENTION

1. Field of the Invention

The present invention relates to pile articles, particularly to pile articles having excellent flexibility, bulkiness and covering ability and provided with guard hairs having uniform and beautiful attenuated top ends and to a method for producing the same.

2. Description of the Prior Arts

A large number of attempts for obtaining pile articles having a high grade which can match natural furs have been made but satisfactory articles have not been yet obtained. The pile articles having a high grade need a double structure of long guard hairs having a large fineness and short crimped wools (under hairs) having a small fineness similar to fur and further have many problems to be improved in each of the guard hair and the wool.

SUMMARY OF THE INVENTION

An object of the present invention is to provide an article having excellent guard hairs and a method for easily producing the same.

The present invention lies in a pile article which is a cloth-like fibrous structure provided with piles having a length of more than 10 mm, each pile consisting of a non-attenuated portion where the fineness does not substantially vary in the length direction, an attenuated portion where the fineness is gradually reduced toward the top end and a fine top end, characterized in that (a) the non-attenuated portion is composed of a core-sheath composite fiber having a flatness ratio of 1.5–5 and a fineness of 8–50d which has 1–4 wing-shaped projections in cross-section, (b) the top end is formed of an exposed core of the composite fiber and has a substantially uniform fineness of an average diameter of 5–25 μm and a length of 0.3–5 mm and (c) the attenuated portion has a length of 1–15 mm.

A method of producing a pile article of the present invention comprises rotating a cloth-like fibrous structure provided with cut piles having a length of more than 10 mm and composed of sheath-core composite fibers, each consisting of a sheath of a fiber-forming polyester and a core of a thermoplastic polymer of which the decomposition rate in an aqueous solution of NaOH is less than ½ that of the polyester, and having 1–4 wing-shaped projections, a flatness ratio of 1.5–5, an average diameter of the core portion of 5–25 μm and a fineness of 8–50d fixed to a rotating body, contacting the piles with an aqueous solution of an alkali while varying the contacted length by applying a centrifugal force in a direction to which the piles are raised, to gradually attenuate the piles torward the top end, and completely decomposing and removing the sheath polymer at the top end portion.

DESCRIPTION OF THE PREFERRED EMBODIMENTS

The guard hair of the pile article of the present invention consists of the non-attenuated portion, the attenuated portion and the top end. The top end must be uniform. The fineness at the top end must be 5–25 μm in the average diameter and particularly the range of 10–20 μm is preferable. Similarly, the fineness at the top end is preferred to be less than ½, particularly 1/5 ~ 1/20 that of the non-attenuated portion. The term "average diameter" used herein means, in the case of a circular cross-section, a diameter thereof and in the case of a non-circle, a diameter of a circle having the equal area to the non-circle. The fineness of the top end portion is substantially uniform in the longitudinal direction and is a range which is regarded as substantially constant (for example, the variation of the average diameter is within 30%, particularly within 20%). The length of the top end needs 0.3–5 mm and is particularly preferred to be 0.5–2 mm. If the top end is too short, the appearance and the touch are poor and if the top end is too long, the top ends are readily entangled with one another. Similarly, if the top end is too fine, the top ends are readily entangled and if the top end is too thick, the appearance and the touch are rough and rigid.

The article obtained by completely removing the sheath of the composite fiber at the top end and exposing the core is excellent in the uniformity.

The attenuated portion is the portion by which the top end and the non-attenuated portion are connected and is gradually, preferably smoothly attenuated toward the top end. The length of the attenuated portion is very important for the fine view and the touch and must be 1–15 mm, preferably 2–10 mm. When this length is short, the top end and the non-attenuated portion are unnaturally connected and the fine view and the flexibility are lost. When the attenuated portion is too long, the resiliency, bulkiness, covering ability, luster and the like of the piles are apt to be poor.

Figure 1:
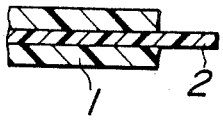
FIG. 1 PRIOR ART
FIG. 1 is a vertical sectional view of a composite fiber in a well-known pile wherein a core is projected.
Figure 2:
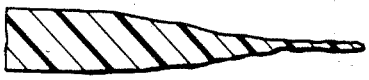
FIG. 2 PRIOR ART
FIG. 2 and FIG. 3 are vertical sectional views of the top ends of polyester piles attenuated with a strong alkali.

FIG. 1 shows a cross-section of a top end portion of a well-known pile in which a sheath 1 of a sheath-core composite fiber is shrunk whereby a core 2 is projected. In this case, there is no attenuated portion which is a transferring portion between the non-attenuated portion and the top end, so that such an article is rough in the fine view and touch and is poor. FIG. 2 is an explanatory view of the vertical section of a pile which is attenuated (sharpened) by treating a top end portion of a polyester (for example, polyethylene terephthalate and the like) fiber with an aqueous solution of an alkali. In general, when a polyester pile is attenuated with an aqueous solution of a strong alkali (in a high speed, efficiency), the action with said aqueous solution irregularly proceeds as shown in FIG. 2 and an uneven or abnormally fine portion are formed (the top end is liable to be bent or broken) and it is difficult to control the top end portion in a uniform and desirable fineness and length.

Figure 3:
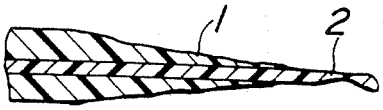
FIG. 3 PRIOR ART

FIG. 3 is an embodiment wherein the top end of a sheath-core composite fiber composed of two polyesters which are different in the content of a pigment but are substantially equal in the decomposition rate owing to an alkali, is treated with an alkali and the attenuated state is essentially equal to that of FIG. 2. Namely, the core 2 is exposed but it is impossible to properly control the length and the fineness and in many cases, the length is very short (less than 0.2 mm) and the performance serving as the top end is lost or conversely, the top end becomes very fine and long (for example, diameter: less than 5 μm, length: more than 1 mm), and is lack in the uniformity and the entanglement and bending are apt to be caused and such an article is poor in the aesthetic view.

The drawbacks of the prior arts as mentioned above are solved according to the method of the present invention. Namely, the present invention uses sheath-core composite fibers consisting of a core having a relatively higher resistance to an aqueous solution of an alkali and a sheath having a lower resistance thereto, whereby the top end having the desired fineness and length can be uniformly, easily and efficiently obtained.

Figure 4:
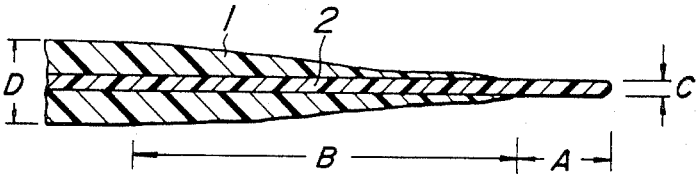
FIG. 4 is a vertical sectional view showing an embodiment of a top end of a guard hair of an article of the present invention.

FIG. 4 is an explanatory view of a vertical section of a top end portion of a pile (guard hair) of an article of the present invention. In FIG. 4, a numeral 1 is a polyester sheath, a numeral 2 is a core, a figure A shows a length of the top end, a figure B shows a length of the attenuated portion, a figure C shows a diameter of the top end and a figure D shows a diameter of the non-attenuated portion. The core is lower in the decomposition rate than the sheath polymer in an aqueous solution of an alkali. The decomposition rate in the aqueous solution of an alkali is determined as follows. For example, the fibers are treated with 15% aqueous solution of NaOH at 100° C. to determine the weight reduction curve thereof (time variation) and said decomposition rate is shown by a gradient (weight reduction ratio per unit time) of the curve at the point of 50% of the weight reduction. As the decomposition rate of the core polymer is smaller, the top end is exposed without being damaged. The decomposition rate of the core polymer must be less than ½ that of the sheath polymer, particularly less than 1/5, most preferably less than 1/10.

The shape of the non-attenuated portion of the guard hair also is very important. Since the guard hairs generally cover the surface of fur, the guard hairs must be synthetically excellent in view of many points, such as appearance (bulkiness, resiliency, covering ability, luster, color, visible fineness, etc.), touch (flexibility, elasticity, slidability), hair looseness, heat insulation and light weight. Furthermore, the cross-sectional shape of the guard hair should be one in which the attenuation owing to the aqueous solution of an alkali smoothly proceeds.

Figure 5:
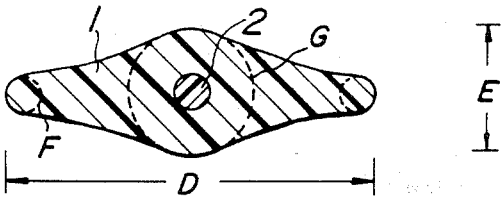
FIGS. 5–13 are embodiments of cross-section of sheath-core composite fibers suitable for guard hairs of the articles of the present invention.

FIGS. 5-13 are embodiments of cross-sections of the fibers suitable for the guard hairs (non-attenuated portion) of the articles of the present invention. In these drawings, a numeral 1 shows the sheath and a numeral 2 shows the core. The embodiment in FIG. 5 has two wing-like projections and the core 2 positions at the center. The long diameter is designated by D and the short diameter (a diameter perpendicular to D passing through a center of the largest inscribed circle G) is designated by E. The flatness ratio is a ratio of the long diameter/the short diameter, that is D/E. The wing-like projection (referred to as "wing" hereinafter) is an external portion of the largest inscribed circle G, where the breadth is gradually reduced toward the terminal. A diameter of an inscribed circle F at the terminal should be smaller than that of the largest inscribed circle G. The breadth of the wing must be monotonously smaller toward the terminal and there should not be constricted parts. This is necessary for smoothly reducing the breadth of the attenuated portion of the pile with the alkali treatment. The diameter of the inscribed circle F at the wing terminal is preferred to be less than 30 μm, more preferably less than 20 μm and most preferably 3-10 μm. Similarly, the diameter of the inscribed circle at the wing terminal is preferred to be less than ½, more preferably less than 1/3 the diameter E of inscribed circle G. FIG. 5 is an embodiment wherein two wings lie on a straight line and which is excellent in the flexibility and covering ability and is the most preferable one for the object of the present invention.

Figure 6:
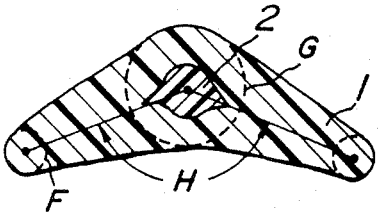

FIG. 6 is an embodiment in which two wings do not lie on a straight line but lie on two straight lines which intersect at an angle H. The angle H is preferred to be 120°-240° (FIG. 5 is an embodiment of 180°). The core may be circular as shown in FIG. 5 or may be non-circular as shown in FIG. 6. The core is a component important for forming the top end of the pile. An average diameter of the core must be 5-25 μm and 10-20 μm is most preferable.

Figure 7:
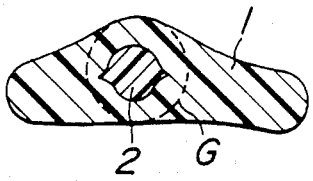
Figure 8:
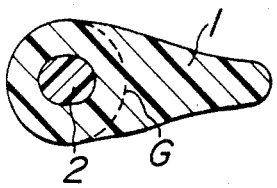

FIG. 7 is an embodiment wherein the size of two wings is different and assymetry and FIG. 8 is an embodiment wherein the wing is single.

FIGS. 9-13 are embodiments wherein the number of the wings is 3 or 4.

Figure 9:
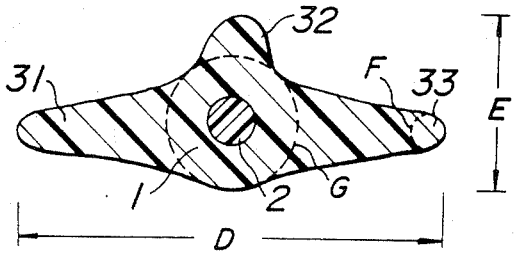

In FIG. 9, an angle between the wings 31 and 32 is 100°, an angle between the wings 32 and 33 is 85° and an angle between the wings 33 and 31 is 175°. The length and angle of the wings may be optionally selected so that the flatness ratio is 1.5-5.

Figure 10:
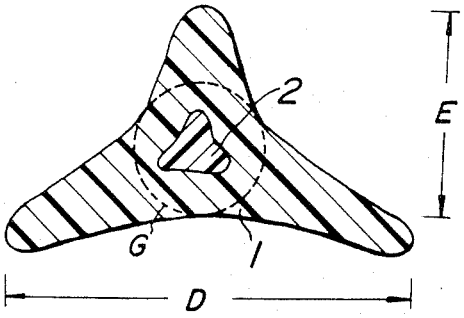

FIG. 10 is an embodiment wherein the angles formed by three wings are different from those of FIG. 9.

Figure 11:
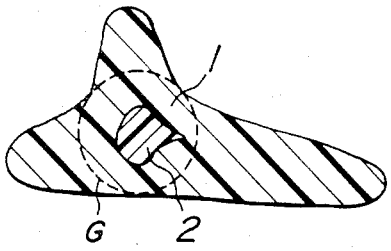
Figure 12:
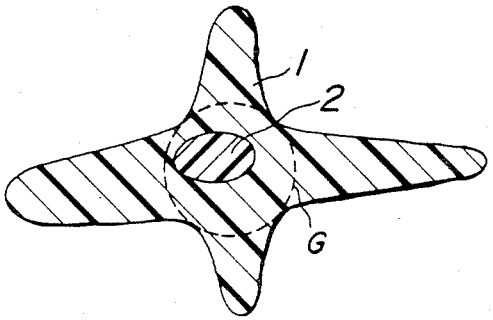
Figure 13:
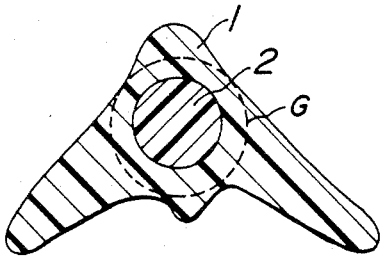

FIG. 11 is an embodiment wherein one wing is particularly large and the symmetry is low and FIGS. 12 and 13 are embodiments having four wings.

The articles having the wing number of 1 or 2 are excellent in the flexibility and covering ability and the articles having the wing number of 3 or 4 are excellent in the luster, resiliency and bulkiness.

The fineness of the guard hairs (non-attenuated portion) is 8-50d. When the fineness is too large, the pile article becomes rough and rigid, while when the fineness is too small, the bulkiness, resiliency and luster are poor. The fineness of guard hairs is particularly preferred to be 10-30d. The flatness ratio of the guard hair (non-attenuated portion) must be 1.5-5, particularly 2-4. If the flatness ratio is too large, the pile becomes excessively flexible and is apt to be fibrillated. On the other hand, when the flatness ratio is too small, the flexibility, luster, covering ability and heat insulation of the piles are poor. Such piles having 1-4 wings in the cross-section are not only excellent in view of the bulkiness, resiliency, flexibility and luster as the guard hairs, but also are excellent in the hair loosening ability and brushing ability and further the piles can be easily, finely, smoothly and uniformly attenuated.

The sheath polymers must be easily decomposed by an aqueous solution of a strong alkali (NaOH, KOH, etc.). The preferable polymers are, for example, fiber-forming polyesters, such as polyethylene terephthalate, polybutylene terephthalate, polyethylene oxybenzoate, polydimethyl cyclohexane terephthalate, etc., and modified polyesters in which these polymers are the main component (more than 50%) and a third component is copolymerized or blended therewith.

The core polymer has a higher resistance against an aqueous solution of an alkali than the sheath polymer and is, for example polyamides, polyolefins, polyvinyls, polyurethanes, and polyesters having a low modification degree or unmodified polyesters. The core and the sheath are preferred to be melt-conjugate spinnable and to be mutually adhesive. Unmodified or a low modification degree of polybutylene terephthalate (abbreviated as "PBT" hereinafter) is the most preferable embodiment as the core polymer. Namely, these polymers are high in the resistance against an aqueous solution of an alkali, have the adhesion to other polyesters, for example, polyethylene terephthalate (abbreviated as "PET" hereinafter) and are high in the elastic recovery against bending strain, so that such polyesters have the characteristic that the shape of the pile top end is correctly retained and the piles are hardly entangled. As the sheath polyesters to be combined with the core PBT, mention may be made of modified PBT and PET in which 1-30% of a third component is copolymerized or blended, and other fiber-forming polyesters having a modification ratio of 1-30%. As examples of modification owing to the copolymerization of polyesters, mention may be made of polymers obtained by copolymerizing with about 1-30% by weight of linear chain dicarboxylic acids, such as adipic acid, sebacic acid; aromatic dicarboxylic acids, such as isophthalic acid, sulfoisophthalic acid, naphthalene dicarboxylic acid; linear chain glycols, butylene glycol, hexanediol, etc.; polyalkylene glycols, such as polyethylene glycol, polypropylene glycol, polybutylene glycol, etc. As examples of modification owing to blend, mention may be made of polymers obtained by melt-blending about 1-30% of polyalkylene glycols, aliphatic polyesters (polyethylene adipate, polybutylene adipate, polycaprolactam, etc.), polyalkylene glycol/polyester block copolymer, aliphatic/aromatic copolymerized polyesters, etc. In particular, when a compound having sulfone group or ether linkage is copolymerized or blended, the resistance against an alkali lowers and the modifying effect is high.

Unmodified PET and other homopolyesters are preferable following to PBT as the core polymer and the sheath polymers to be combined herewith are preferably modified PET, modified PBT and other modified polyesters. When the sheath and the core are the common polyester, the modification ratio (the copolymerization or blend ratio) of the sheath is preferred to be higher by 1-30%, particularly 5-20% than that of the core. Polyamides, such as nylon-6, nylon-66, nylon-12, nylon-610 and the copolymers thereof are preferable as the core component. Polyamides are poor in the adhesion to the sheath component of polyester but have such characteristics that the resistance against an alkali is high and the retension of the shape of the exposed top end is excellent (the top end is hardly bent). The addition of a delusterant such as titanium oxide, a coloring agent to the core or sheath polymer is optional but in order to obtain a good luster, it is preferable to add less than 0.5% by weight, particularly less than 0.2% by weight of the delusterant.

The above described sheath-core composite fibers can be produced by a well-known melt-conjugate spinning. Both the components are separately melted and metered and then conjugate-spun, for example, in a conjugate ratio of core to sheath of $\frac{1}{2} \sim 1/50$, particularly $1/5 \sim 1/20$ through flat orifices, cooled, applied to oiling and wound up. If necessary, after drawing and hot-treating, the thus obtained fibers are used as pile yarn and the like in the form of continuous filaments or spun yarns. When a high speed spinning (more than 2,000 m/min particularly more than 4,000 m/min) is effected, the drawing may not be needed. When the fibers are used as the pile yarns, they may be used through doubling, doubling and twisting and mix spinning with the yarns for wools.

As the processes for producing the pile articles, use may be made of well-known pile weaving or pile knitting, silver knitting, tufting, electric flocking or raising process but the pile weaving or pile knitting process is high in the uniformity and optimum. By using these processes, the cut pile article having the desired cut length (more than 10 mm) of guard hairs is prepared, and then, if necessary the wools are cut and the guard hairs are attenuated at the top end, dyed, decolored, and subjected to a finish processing, backing, brushing process and the like to obtain an artificial fur.

The fineness of wools is preferred to be less than 5d, particularly less than 3d and most preferably 0.5-3d. The wools are preferred to be moderately crimped and the cross-section may be circular or non-circular (for example, gourd shape or dumb-bell shape is preferable). The material polymers may be anyone of polyamides, polyesters, polyvinyls and the like but are preferred to be polyesters which can be cut with an aqueous solution of an alkali. The density of wools is preferably about 3,000-30,000 filaments/cm$^2$, particularly about 5,000-20,000 filaments/cm$^2$. The density of guard hairs is preferred to be about 200-2,000 filaments/cm$^2$, particularly about 300-1,200 filaments/cm$^2$ and it is easy to flock the piles in such a range. Furthermore, it is possible to increase the pile density by shrinking the substrate fabric in a processing step.

The inventors have disclosed the method for highly processing the pile articles by utilizing the centrifugal force and the articles obtained through the said method in Japanese Patent Laid Open Application Nos. 56(1981)-15,486, 56(1981)-37334, 56(1981)-49,048, 57(1982)-117,648, 57(1982)-121,643, etc. By applying this centrifugal force processing method to the present invention, it is possible to effect the cutting of wools, attenuating of guard hairs, dyeing, decoloring and the like.

The preferable process for cutting the wools comprises raising the wool fibers having the highr decomposing or dissolving rate than the guard hairs, immersing the position far a given distance from the substrate fabric in an aqueous solution of an alkali and the like and cutting (dissolving off) the wools at the immersed position. In order to make the attenuation or damage of the guard hairs in the step for cutting the wools as low as possible, it is desirable that the decomposition rate of the wools in an aqueous solution of an alkali is much higher than that of the guard hairs. In reality, even if the polymer of the wools is same as that of the guard hairs, the wools are faster cut by making fineness of the wools smaller than that of the guard hairs and the damage of the guard hairs may be reduced to the substantially negligible degree (the reduction of diameter is less than 20%, particularly less than 10%). Of course, by using the wool polymer having a higher decomposition rate in an aqueous solution of an alkali than that of the guard hair polymer, for example, having the rate ratio of more than 1.5, particularly more than 3, it is possible to substantially neglect (weight reduction: less than 10%, particularly less than 5%) the attenuation and damage of the guard hairs due to the cutting of the wools.

The preferable process for attenuating the top end of the guard hairs comprises similarly raising the guard hairs by the centrifugal force and dissolving off partially the sheath of the composite fibers while gradually varying the depth of immersion in an aqueous solution of an alkali (while moving the solution surface) from a desired distance (original point) distant from the substrate fabric to the other desired distance (final point). Of course, at the top end of the piles, the sheath along the desired length is completely removed. By such a treatment for attenuating the piles, the composite fibers having the above described wings and the core having a high resistance against an alkali are gradually attenuated finely, smoothly and uniformly toward the top end.

The centrifugal processing method is applicable to the dyeing, decoloring and the like of piles but this have been explained in detail in the above mentioned Laid Open Applications and is omitted.

The present invention can provide high grade of artificial furs which can match natural furs, which are provided with beautiful piles having uniform top ends and smoothly attenuated portions and are excellent in the bulkiness, resiliency, flexibility, luster, covering ability, touch and light weight.

The following examples are given for the purpose of illustration of this invention and are not intended as limitations thereof. In the following examples, "part" and "%" mean "by weight" unless otherwise indicated. "Relative viscosity" means one obtained by measuring a specimen in 1% solution in a mixed solvent of phenol/-tetrachloroethane of 1:1 (volume ratio) at 20° C.

EXAMPLE 1

PBT having a relative viscosity of 2.45 is referred to as "polymer P1". Modified PET copolymerized with 5% of polyethylene glycol having a molecular weight of 600, which has a relative viscosity of 1.80 and a content of titanium oxide being 0.1% is referred to as "polymer P2". The decomposition rate of P1 in an alkali solution is about 1/10 that of P2.

The polymer P1 (core) and the polymer P2 (sheath) were melt-conjugate-spun in a sheath-core type. The polymers were spun through slit-shaped orifices having an enlarged center at 285° C., applied to cool oiling, wound up at a rate of 1,200 m/min, drawn at 90° C. to 3.6 times the original length and heat-treated at 150° C. under tension to obtain drawn yarn Y1 of 140d/7f (monofilament: 20d) and having the cross-section as shown in FIG. 5. The cross-section of Y1 has the following dimensions. The long diameter (D) is 110 μm, the short diameter (E) is 35 μm, the flatness ratio is 3.14, the diameter of an inscribed circle at the top end of the wing is 12 μm, and the diameter of the core is 15 μm (corresponding to about 2.5d). Modified PET (relative viscosity: 1.72, content of titanium oxide particle: 0.7%) copolymerized with 4% of sodium sulfoisophthalate and 3% of polyethylene glycol having a molecular weight of 600 was melt-spun, drawn and hot-treated to obtain a yarn having gourd-shaped cross-section (flatness ratio: 2.2) and 150d/110f, which is referred to as "Y2". Y2 was false-twisted at a twist number of 2,400 T/m and 200° C., and heat-treated with a non-contact heater at 220° C. under a low tension to obtain a yarn "YF2" having a controlled crimp.

One yarn of Y1 and one yarn of YF2 were uniformly doubled with an air jet nozzle and then twisted at 90 T/m to obtain "PY1".

PY1 was used as a pile yarn and usual polyester spun yarn (single yarn: 1.5d, 40 count two-ply yarn corresponding to 266d) was used as a warp and a weft to obtain a cut pile woven fabric (CP1). The pile density of CP1 is 75/cm$^2$, w type flock, the pile length is 34 mm. CP1 was subjected to the centrifugal process in the process disclosed in Japanese Patent Laid Open Application No. 56(1981)-15,486. That is, CP1 was fixed on a cylinder (inner cylinder) having a diameter of 1 m and rotated together with a cylindrical vessel (outer cylinder) containing a treating solution and having a diameter of 1.1 m at a rate of 600 rpm (centrifugal force: about 200 G) and the outer cylinder was heated at about 150° C. with infrared ray and heat-treated for 15 minutes. Then, 15% aqueous solution of NaOH was gradually introduced into the outer cylinder and charged so that the inner surface of said aqueous solution formed owing to centrifugal force caused by the rotation of the outer cylinder reached a point 22 mm distant from the substrate fabric of the cut pile fabric CP1 and said fabric CP1 was treated with the aqueous solution at 100° C. for 10 minutes and then the aqueous solution was discharged out and said fabric CP1 was washed with water. The wools were cut at the position 22 mm distant from the substrate fabric with this treatment but the damage of the guard hairs was slight (the reduction rate of the diameter: about 8%).

Then, 20% aqueous solution of NaOH was gradually charged into the outer cylinder and the solution surface was maintained at a position 33 mm distant from the substrate fabric and the cut pile fabric was treated at 100° C. for 15 minutes with said solution and then the solution surface was moved from the position 33 mm distant from the substrate fabric to a position 27 mm distant from the substrate fabric in 45 minutes and then discharged out and the cut pile fabric was washed with water. The top end of the guard hairs were attenuated with this treatment and the diameter of the top end was about 15 μm, the length was about 2 mm and the core polymer was not substantially damaged. The decomposition rate of the core polymer (PBT) due to the alkali is about 1/10 that of the sheath polymer. The length of the attenuated portion is about 7 mm, the long diameter of the non-attenuated portion is about 102 μm, the short diameter is 33 μm, and these diameters are somewhat smaller than those of the untreated portion (root portion) but the non-attenuated portion maintains substantially the original shape.

An aqueous solution of a brown dispersion dyestuff (concentration: 0.1 g/l) was charged into the outer cylinder to a position 2 mm distant from the substrate fabric and the cut pile fabric was treated with said solution at 98° C. for 20 minutes and the solution was discharged out and said fabric was washed with water and then 1.2 g/l of aqueous solution of the same dyestuff as described above was charged to a position 23 mm distant from the substrate fabric and the treatment was effected at 98° C. for 20 minutes, said solution was discharged out and the cut pile fabric was washed with water. The wools were dyed in a light brown and the upper portion of the guard hair than 23 mm was dyed in a dark brown with this treatment.

A solution of 10 g/l of Nikka Sansalt CM-7 (surfactant, product of Nikka Kagaku Kogyo, Ltd.), 5 g/l of hydrosulfite, 3 g/l of soda ash, 2 g/l of Amiradin D (surfactant, product of Daiichi Kogyo Seiyaku Ltd.) and 1 g/l of chlorobenzene dissolved in water was filled to a position 29 mm distant from the substrate fabric and the treatment was effected at 98° C. for 60 minutes and then the solution surface was gradually raised and reached to a position 26 mm distant from the substrate fabric in 20 minutes, after which the solution was discharged out and the cut pile fabric was washed with water. The portion of 4 mm of the top end of the guard hairs was decolored to a light brownish grey near white and the portion of about 4 mm lower than said portion was gradationally decolored.

Then, the rotation rate was changed to 300 rpm (about 50 G) and an aqueous dispersion of a fluorine resin base water repellent and oil repellent stainproofing agent was filled to a position 1 mm distant from the substrate fabric and immediately discharged out, after which the outer cylinder was kept at 160° C. and the treatment was effected for 20 minutes and then the thus treated cut pile fabric was taken out of the centrifugal machine and an aqueous solution of polyurethane resin was applied on a rear surface of the substrate fabric and dried to obtain an artificial fur SF1.

For comparison, sheath-core composite fibers (circular cross-section, single yarn: 20d) wherein the polymer P1 and the polymer P2 were conjugate-spun in a concentric circle-shape were used instead of the above described Y1 and were processed similarly to CP1 in the succeeding steps to obtain an artificial fur SF2.

Furthermore, for comparison, fibers (single yarn: 20d) composed of only the polymer P2 and having the similar flat cross-section to Y1 were used instead of Y1 and similarly processed to CP1 in the succeeding steps to obtain an artificial fur SF3.

The guard hairs of SF1–SF3 were compared in various view points and the obtained results are shown in the following Table 1.

TABLE 1

| Item | SF1 Present invention | SF2 Comparative Example | SF3 Comparative Example |
|---|---|---|---|
| Uniformity of the top end | o | o | x |
| Uniformity of the attenuated portion | o | o | x |
| Flexibility | o | x | o |
| Covering ability | o | x | o |
| Luster | o | x | o |
| Entanglement at the top end | o | o | x |
| Fine view of the attenuated portion | o | x | Δ |
| Fine view of the top end | o | o | x |

Note:
o: Good
Δ: Somewhat poor
x: Poor

When the top ends of the guard hairs are decolored as in the above described example, the uniformity of the top end and the smoothness of the attenuated portion are apparently recognized by naked eyes, the excellent ones give beautiful impression and ones which are poor in the uniformity and smoothness give rough impression. In particular, ones wherein the content of the delusterant is small and the top ends of the guard hairs are partially or completely decolored, vary the luster according to the light source and the seeing angle and develop the unique optical effect. This specific reflection provides the following noticeable effect.

(A) The light portion and the dark portion show clear comparison similar to the anisotropic reflection of velvet.

(B) The collected portion of piles are bright and the diverged portion is dark, so that if the piles are shaped, for example, in waveform, a complicated three-dimensional pattern is formed.

(C) When the pile article is finished in a coat, a contour portion is emphasized bright to cause a beautiful silhouette. These effects are highest when the top ends and the attenuated portions are uniformly, beautifully and smoothly finished and the non-attenuated portion has satisfactory thickness (the long diameter is large).

EXAMPLE 2

An artificial fur SF4 was obtained in the same manner as in the production of SF1 except for using PET having a relative viscosity of 1.8 as the core polymer instead of the polymer P1 in Example 1.

In this case, the decomposition rate of the core polymer in an alkali solution is about $\frac{1}{3}$ that of the sheath polymer. The top end of SF4 was somewhat damaged but was very slight as compared with SF3 and was satisfactorily beautiful and was low in the entanglement and excellent.

EXAMPLE 3

Various artificial furs wherein the diameter of the top end was varied were produced in the same manner as in the production of SF1 in Example 1 except for varying the conjugate ratio of the sheath and the core of the fiber for the guard hair. The reaction condition was adjusted so as to obtain a length of the top end being 2 mm. The relation of the diameter of the top end to the properties of the top end of the guard hairs of the produced articles is shown in the following Table 2.

TABLE 2

| Top end diameter | 4 μm | 8 μm | 12 μm | 20 μm | 30 μm |
|---|---|---|---|---|---|
| Touch (flexibility) | o | o | o | o | o |
| Fine view | o | o | o | Δ | x |
| Entanglement | x | Δ | o | o | o |

EXAMPLE 4

Various artificial furs were prepared in the same manner as in the production of SF1 in Example 1 except for varying the flatness ratio of the fibers for the guard hairs. The relation of the flatness ratio to the properties of the produced articles is shown in the following Table 3.

TABLE 3

| Flatness ratio | 1.4 | 2.3 | 3.5 | 4.2 | 5.6 |
|---|---|---|---|---|---|
| Flexibility | x | Δ | o | o | o |
| Covering ability | x | Δ | o | o | o |
| Resiliency | o | o | o | Δ | x |
| Luster | Δ | o | o | o | o |
| Anisotropic luster | Δ | o | o | o | o |
| Fibrillation | o | o | o | o | x |

EXAMPLE 5

PBT having a relative viscosity of 2.45 is referred to as "polymer P3". Modified PET copolymerized with 5% of polyethylene glycol having a molecular weight of 600, which has a relative viscosity of 1.80 and a content of titanium oxide being 0.1% is referred to as "polymer P4". The decomposition rate of P3 in an alkali solution is about 1/10 that of P4.

The polymer P3 (core) and the polymer P4 (sheath) were melt-conjugate-spun in a sheath-core type. The polymers were spun through a Y-shaped orifice at 285° C., applied to cool oiling, wound up at a rate of 1,200 m/min, drawn at 90° C. to 3.6 times the original length and heat-treated at 150° C. under tension to obtain drawn yarn Y3 of 140d/7f (single yarn: 20d) and having the cross-section as shown in FIG. 10. The cross-section of Y3 has the following dimensions. The long diameter (D) is 95 μm, the short diameter (E) is 40 μm, the flatness ratio is 2.38, the diameter of an inscribed circle at the terminal of the wing is 10 μm, and the average diameter of the core is 15 μm (corresponding to about 2.5d). Modified PET (relative viscosity: 1.72, content of titanium oxide particle: 0.7%) copolymerized with 4% of sodium sulfoisophthalate and 3% of polyethylene glycol having a molecular weight of 600 was melt-spun, drawn and hot-treated to obtain a yarn having gourd-shaped cross-section (flatness ratio: 2.2) and 150d/110f, which are referred to as "Y4". Y4 was false-twisted at a twist number of 2,400 T/m and 200° C., and heat-treated with a non-contact heater at 220° C. under a low tension to obtain a yarn "YF4" having a controlled crimp.

One yarn of Y3 and one yarn of YF4 were uniformly doubled with an air jet nozzle and then twisted at 90 T/m to obtain "PY2".

PY2 was used as a pile yarn and usual polyester spun yarn (single yarn: 1.5d, 40 count two-ply yarn corresponding to 266d) was used as a warp and a weft to obtain a cut pile woven fabric (CP2). The pile density of CP2 is 75/cm$^2$, w type flock, the pile length is 34 mm. CP2 was subjected to the centrifugal process in the process disclosed in Japanese Patent Laid Open Application No. 56(1981)-15,486. That is, CP1 was fixed on a cylinder (inner cylinder) having a diameter of 1 m and rotated together with a cylindrical container (outer cylinder) containing a treating solution and having a diameter of 1.1 m at a rate of 600 rpm (centrifugal force: about 200 G) and the outer cylinder was heated at about 150° C. with infrared ray and heat-treated for 15 minutes. Then, 15% aqueous solution of NaOH was gradually introduced into the outer cylinder and charged so that the inner surface of said aqueous solution formed owing to centrifugal force caused by the rotation of the outer cylinder reached a point 22 mm distant from the substrate fabric of the cut pile fabric CP2 and said fabric CP2 was treated with the aqueous solution at 100° C. for 10 minutes and then the aqueous solution was discharged out and said fabric CP2 was washed with water. The wools were cut at the position 22 mm distant from the substrate fabric with this treatment but the damage of the guard hairs was slight (the reduction rate of the diameter: about 8%).

Then, 20% aqueous solution of NaOH was gradually introduced into the outer cylinder and the solution surface was maintained at a position 33 mm distant from the substrate fabric and the cut pile fabric was treated at 100° C. for 15 minutes with said solution and then the solution surface was moved from the position 33 mm distant from the substrate fabric to a position 27 mm distant from the substrate fabric in 45 minutes and then discharged out and the cut pile fabric was washed with water. The top end of the guard hairs were attenuated with this treatment and the diameter of the top end was about 15 μm, the length was about 2 mm and the core polymer was not substantially damaged. The decomposition rate of the core polymer (PBT) in the alkali solution is about 1/10 that of the sheath polymer. The length of the attenuated portion is about 7 mm, the long diameter of the non-attenuated portion is about 90 μm, the short diameter is 34 μm, and these diameters are somewhat smaller than those of the untreated portion (root portion) but the non-attenuated portion maintains substantially the original shape.

An aqueous solution of a brown dispersion dyestuff (concentration: 0.1 g/l) was charged into the outer cylinder to a position 2 mm distant from the substrate fabric and the cut pile fabric was treated with said solution at 98° C. for 20 minutes and the solution was discharged out and said fabric was washed with water and then 1.2 g/l of aqueous solution of the same dyestuff as described above was charged to a position 23 mm distant from the substrate fabric and the treatment was effected at 98° C. for 20 minutes, said solution was discharged out and the cut pile fabric was washed with water. The wools were dyed in a light brown and the upper portion of the guard hair than 23 mm was dyed in a dark brown with this treatment.

A solution of 10 g/l of Nikka Sansalt CM-7 (surfactant, product of Nikka Kagaku Kogyo Ltd.) 5 g/l of hydrosulfite, 3 g/l of soda ash, 2 g/l of Amiradin D (surfactant, product of Daiichi Kogyo Seiyaku Ltd.) and 1 g/l of chlorobenzene dissolved in water was filled to a position 29 mm distant from the substrate fabric and the treatment was effected at 98° C. for 60 minutes and then the solution surface was gradually raised and reached to a position 26 mm distant from the substrate fabric in 30 minutes, after which the solution was discharged out and the cut pile fabric was washed with water. The portion of 4 mm of the top end of the guard hairs was decolored to a light brownish grey near white and the portion of about 4 mm lower than said portion was gradationally decolored.

Then, the rotation rate was changed to 300 rpm (about 50 G) and an aqueous dispersion of a fluorine resin base water repellent and oil repellent stainproofing agent was filled to a position 1 mm distant from the substrate fabric and immediately discharged out, after which the outer cylinder was kept at 160° C. and the treatment was effected for 20 minutes and then the thus treated cut pile fabric was taken out of the centrifugal machine and an aqueous solution of polyurethane resin was applied on a rear surface of the substrate fabric and dried to obtain an artificial fur SF5.

For comparison, sheath-core composite fibers (circular cross-section, single yarn: 20d) wherein the polymer P3 and the polymer P4 were conjugate-spun in a concentric circle-shape were used instead of the above described Y3 and were processed similarly to CP2 in the succeeding steps to obtain an artificial fur SF6.

Furthermore, for comparison, fibers (single yarn: 20d) composed of only the polymer P4 and having the similar flat cross-section to Y3 were used instead of Y3 and similarly processed to CP2 in the succeeding steps to obtain an artificial fur SF7.

The guard hairs of SF5–SF7 were compared in various view points and the obtained results are shown in the following Table 4.

TABLE 4

| Item | SF5 Present invention | SF6 Comparative Example | SF7 Comparative Example |
|---|---|---|---|
| Uniformity of the top end | o | o | x |
| Uniformity of the attenuated portion | o | o | x |
| Flexibility | o | x | o |
| Covering ability | o | x | o |
| Luster | o | x | o |
| Entanglement at the top end | o | o | x |
| Fine view of the attenuated portion | o | x | Δ |
| Fine view of the top end | o | o | x |

Note:
o: Good
Δ: Somewhat poor
x: Poor

When the top ends of the guard hairs are decolored as in the above described example, the uniformity of the top end and the smoothness of the attenuated portion are apparently recognized by naked eyes, the excellent ones give beautiful impression and ones which are poor in the uniformity and smoothness give rough impression. In particular, ones wherein the content of the delusterant is small and the top ends of the guard hairs are partially or completely decolored, vary the luster according to the light source and the seeing angle and develop the unique optical effect. This specific reflection provides the following noticeable effects.

(A) The light portion and the dark portion show clear comparison similar to the anisotropic reflection of velvet.

(B) The collected portion of piles are bright and the diverged portion is dark, so that if the piles are shaped, for example, in waveform, a complicated three-dimensional pattern is formed.

(C) When the pile article is finished in a coat, a contour portion is emphasized bright to cause a beautiful silhouette. These effects are highest when the top ends and the attenuated portions are uniformly, beautifully and smoothly finished and the non-attenuated portion has a satisfactory thickness (the long diameter is large).

EXAMPLE 6

An artificial SF8 was obtained in the same manner as in the production of SF5 except for using PET having a relative viscosity of 1.8 as the core polymer instead of the polymer P3 in Example 5.

In this case, the decomposition rate of the core polymer owing to an alkali is about $\frac{1}{3}$ that of the sheath polymer. The top end of SF8 was somewhat damaged but was very slight as compared with SF7 and was satisfactorily beautiful and was low in the entanglement and excellent.

EXAMPLE 7

Various artificial furs wherein the diameter of the top end was varied were produced in the same manner as in the production of SF6 in Example 5 except for varying the conjugate ratio of the sheath and the core of the fiber for the guard hair. The reaction condition was adjusted so as to obtain a length of the top end being 3 mm. The relation of the diameter of the top end of the properties of the top end of the guard hairs of the produced articles is shown in the following Table 5.

TABLE 5

| Top end diameter | 4 μm | 8 μm | 12 μm | 20 μm | 20 μm |
|---|---|---|---|---|---|
| Touch (flexibility) | o | o | o | o | o |
| Fine view | o | o | o | Δ | x |
| Entanglement | x | Δ | o | o | o |

EXAMPLE 8

Various artificial furs were prepared in the same manner as in the production of SF5 in Example 5 except for varying the flatness ratio of the fibers for the guard hairs. The relation of the flatness ratio to the properties of the produced articles is shown in the following Table 6.

TABLE 6

| Flateness ratio | 1.4 | 2.3 | 3.5 | 4.2 | 5.6 |
|---|---|---|---|---|---|
| Flexibility | x | Δ | o | o | o |
| Covering ability | x | Δ | o | o | o |
| Resiliency | o | o | o | Δ | x |
| Luster | Δ | o | o | o | o |
| Anisotropic luster | Δ | o | o | o | o |
| Fibrillation | o | o | o | o | x |

What is claimed is:

1. A pile article which is a cloth-like fibrous structure provided with piles having a length of more than 10 mm, each pile composed of a non-attenuated portion where the fineness does not substantially vary in the length direction, an attenuated portion where the fineness is gradually reduced toward the top end and a fine top end, said piles comprising that (a) the non-attenuated portion is composed of a core-sheath composite fiber having a flatness ratio of 1.5–5 and a fineness of 8–50d, and has 1–4 wing-shaped projections in cross-section, (b) the top end is formed of an exposed core of the composite fiber and has a substantially uniform fineness of an average diameter of 5–25 μm and a length of 0.3–5 mm and (c) the attenuated portion has a length of 1–15 mm.

2. A pile article as claimed in claim 1, wherein the sheath of the composite fiber is a fiber-forming polyester and the core is a thermoplastic polymer of which the decomposition rate owing to treatment with an aqueous solution of NaOH is less than $\frac{1}{2}$ that of the sheath.

3. A pile article as claimed in claim 1, wherein the average diameter of the top end is 10–20 μm and the length thereof is 0.5–2 mm.

4. A pile article as claimed in claim 1, wherein the length of the attenuated portion is 2–10 mm.

5. A pile article as claimed in claim 1, wherein said article is provided with, other than the piles (referred to as "guard hairs" hereinafter) having a fineness of 8–50d, in which the top end portion is attenuated, piles (referred to as "wools" hereinafter) having a length 3 mm shorter than that of the guard hairs and a fineness of less than 5d.

6. A pile article as claimed in claim 1, wherein the core is polybutylene terephthalate or polyethylene terephtalalate.

7. A method of producing a pile article comprising rotating a cloth-like fibrous structure provided with cut piles having a length of more than 10 mm, which are composed of sheath-core composite fibers, each consisting of a sheath of a fiber-forming polyester and a core of a thermoplastic polymer of which the decomposition rate in an aqueous solution of NaOH is less than ½ that of the polyester, and having 1–4 wing-shaped projections, a flatness ratio of 1.5–5, an average diameter of the core portion of 5–25 μm and a fineness of 8–50d, fixed to a rotating body, contacting the piles with an aqueous solution of an alkali while varying the contacted length by applying a centrifugal force in a direction to which the piles are raised, to gradually attenuate the piles toward the top end, and completely decomposing and removing the sheath polymer at the top end portion.

8. The method as claimed in claim 7, wherein the decomposition rate of the core polymer owing to the treatment with an aqueous solution of NaOH is less than 1/5 that of the sheath polymer.

* * * * *